United States Patent [19]

Saitoh

[11] 4,445,348

[45] May 1, 1984

[54] COMBINATION LOCK

[75] Inventor: Hisashi Saitoh, Kasugai, Japan

[73] Assignee: Saikosha Works Ltd., Kasugai, Japan

[21] Appl. No.: 285,718

[22] Filed: Jul. 22, 1981

[30] Foreign Application Priority Data

Jul. 30, 1980 [JP] Japan ..... 55-109706[U]

[51] Int. Cl.[3] ..... E05B 37/02

[52] U.S. Cl. ..... 70/312; 70/314; 70/317; 70/319

[58] Field of Search ..... 70/312, 23, 319, 30, 70/26, 303 R, 314, 316, 317

[56] References Cited

U.S. PATENT DOCUMENTS

| | | | |
|---|---|---|---|
| 323,941 | 8/1885 | Kubler | 70/312 |
| 583,603 | 6/1897 | Nádas | 70/312 |
| 730,719 | 6/1903 | Taylor | 70/317 |
| 1,240,114 | 9/1917 | Baum | 70/317 |
| 1,332,821 | 3/1920 | Enos | 70/26 |
| 1,583,688 | 5/1926 | Hatch | 70/312 |
| 1,773,204 | 8/1930 | Scheibner | 70/26 |
| 1,834,091 | 12/1931 | Cruse | 70/312 |
| 1,928,853 | 10/1933 | Doenges | 70/316 |
| 2,546,182 | 3/1951 | Fenari | 70/312 |
| 3,720,082 | 3/1973 | Feinberg et al. | 70/312 X |
| 3,826,510 | 7/1974 | Halter | 70/312 X |
| 4,259,856 | 4/1981 | Wingert | 70/312 X |
| 4,312,199 | 1/1982 | Uyeda | 70/316 |

FOREIGN PATENT DOCUMENTS

| | | | |
|---|---|---|---|
| 629119 | 9/1949 | United Kingdom | 70/312 |

*Primary Examiner*—Gary L. Smith
*Assistant Examiner*—Lloyd A. Gall
*Attorney, Agent, or Firm*—Jordan and Hamburg

[57] ABSTRACT

A cylinder type combination lock which is capable of being set in any desired combination of numbers and the like or changed from the once set specific combination to any other combination without using any tool.

8 Claims, 4 Drawing Figures

COMBINATION LOCK

BACKGROUND OF THE INVENTION

1. Field of the Invention

The present invention relates to a combination lock, and more particularly to a cylinder type combination lock in which the combination of numbers or the like can freely be set or changed to any other combination by the user.

2. Description of the Prior Art

Combination locks of the type having means for setting or changing the combination have been known. For instance U.S. Pat. Nos. 3,720,082 to Irving Feinberg et al and 3,766,758 to Henry Heine et al disclose a combination padlock which is capable of being set or changed to any combination of the user's choice. The change of the combination of these padlocks is made by turning dials to the preset combination to open the lock and pull out its shackle, turning the shackle a predetermined degree, pushing in the shackle at the turned position, and then turning the shackle in the opposite direction by a predetermined degree while holding the shackle in the depressed state to release the teeth of sleeves from grooves of the dial, whereby a sleeve-dial relationship may be changed to any desired new combination.

On the other hand, various cylinder type combination locks have hitherto been developed and sold, but within the knowledge of the inventor, there has been proposed no such type combination lock which can easily be set or changed to a combination selected by the user. A specific combination of the conventional cylinder type locks is set by the manufacturer and such locks are sold with a tag attached which shows information on the preset combination for opening the lock. If the user wishes to change the preset combination, he must use a specific tool to release an O-ring which maintains an outermost dial on a core of the lock body, change the relative position of the dials, and fix the O-ring again. Not only is the operation troublesome, but also the variety of possible combinations is limited.

SUMMARY OF THE INVENTION

Accordingly, a principal object of the present invention is to provide a cylinder type combination lock, the combination for which can freely be set or changed to any other combination of the user's choice, which may be numbers corresponding to a birthday, telephone number, house number or the like.

A further object of the invention is to provide a cylinder type combination lock which is simple in structure and in the operation of setting or changing of combination of numbers.

The cylinder type combination lock according to the invention comprises a first body to be connected with one end of a string or chain, which has an integrally formed cylindrical core portion formed with a central key bore, a plurality of inner rings each rotatably mounted on the core portion, a second body to be connected with the other end of the string or chain, which has a key-like projection to be inserted in the key bore of the first body, and a plurality of dial rings each adapted to be fitted on each of the inner rings so as to be integrally rotatable.

In order to attain such integral rotation of the inner ring and the dial ring, the former is provided with a plurality of protrusions on the peripheral outer surface and the latter is formed with a plurality of notches on the peripheral inner surface so as to be engaged with each other.

It is not essential, but there are preferably four inner rings used and consequently four dial rings, each of which may have for instance 10 numerical figures around the peripheral surface so as to represent any of 0, 1, 2 . . . 9.

The inner ring should be formed with a notch on the peripheral inner surface thereof so that when rotating the rings to be in the particular angular position where the notches are all aligned with the key bore of the first body to form an entire key groove, the second body having the key-like projection may be disengaged from the first body having the bore.

It is preferable to provide a spacer between every adjacent two inner rings and spring means for controlled rotation of the ring on the cylindrical core portion of the first body. An O-ring is preferably mounted on the core portion at the free end thereof in order to prevent the outermost inner ring from being disengaged therefrom.

In order to newly set a desired combination, the inner rings are respectively rotated by the user to occupy the particular angular position for opening the lock, namely for disengaging the second body from the first body of the lock. While keeping the inner rings respectively at said positions, the dial rings are fitted on the inner rings one by one so that a desired order of desired numbers are represented. When inserting the key-like projection of the second body into the key bore of the first body and rotating the dial rings, each rotatingly integrated with the concerned inner ring respectively at random, any person who does not know the combination can not open the lock. In order to change the combination, the operation is just the same as the above, but involves disengaging each dial ring from the respective inner ring and changing the relative angular position so as to represent the other combination.

DESCRIPTION OF THE PREFERRED EMBODIMENT

Figure 1:
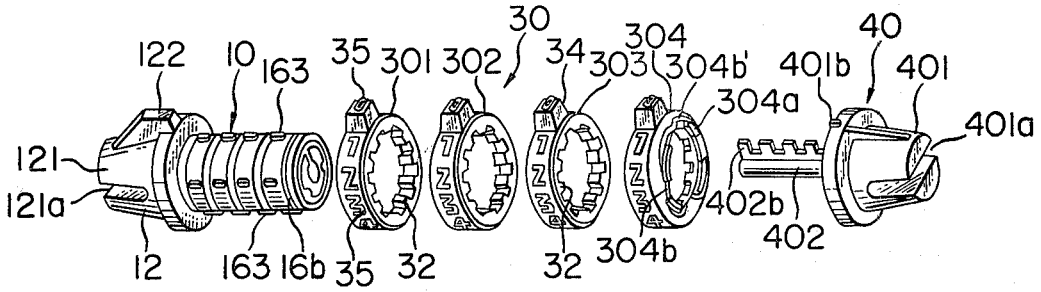
FIG. 1 is an exploded perspective view of a cylinder type combination lock according to the present invention.

Referring to the drawings, a cylinder type combination lock according to the invention essentially comprises a main body 10, four dial rings 30 and a second body 40.

In the illustrated embodiment of the invention, there are four dial rings 301, 302, 303 and 304, each having 10 indicia or numbers, namely integrals 0, 1 . . . 9 on the circumference thereof and internal teeth 32 of corresponding numbers. The dial rings may be of a synthetic resin material. The fourth or outermost dial ring 304 is different from the other three 301–303 in that the dial ring 304 has a plurality of projections **304*a* at its outer side thereof to support a wire spring 304*b* for stably holding the dial ring 304** on the concerned inner ring.

Figure 4:
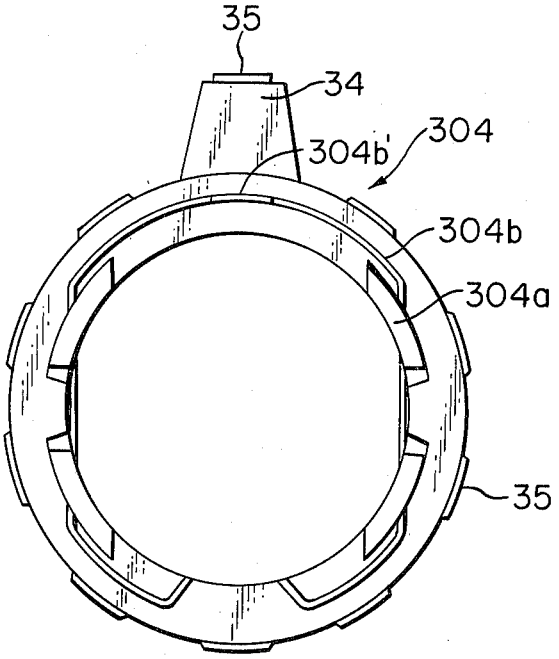
FIG. 4 is a side view of an outermost dial ring with a stopper.

The wire spring 304*b* has a bent portion 304*b'* and two leg portions so that when fitting this dial ring on the concerned inner ring, the legs are resiliently spread and engaged with a circumferential groove of the inner ring and when manually moving the bent portion 304*b'*, the legs are spread to easily disengage the dial ring 304 from the inner ring on the main body 10 (see FIGS. 1 and 4). It is preferable to provide a projection 34 on each dial ring to make the turning operation thereof easy. Each dial ring has 10 portions 35 on the circumference on which numerical figures of 0 to 9 are provided.

Figure 2:
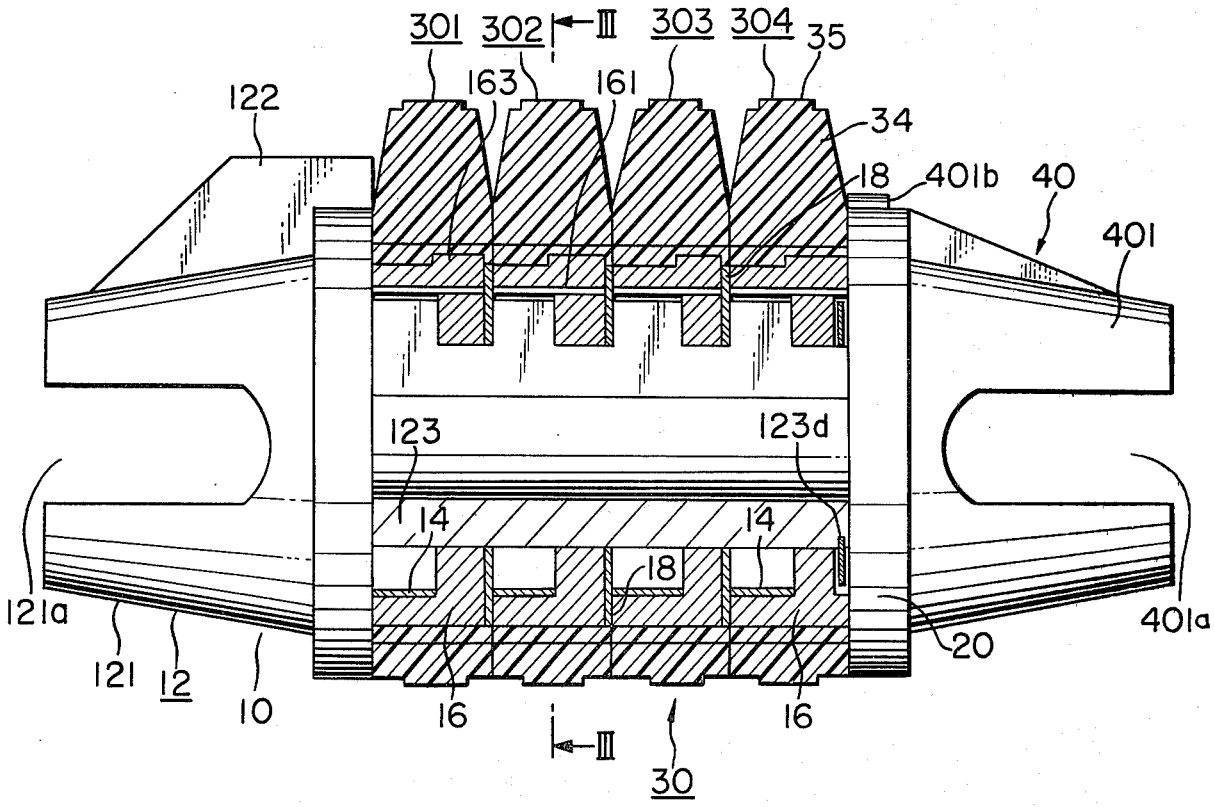
FIG. 2 is an enlarged front view of the lock, a part thereof being shown in section to show essential inner mechanisms.
Figure 3:
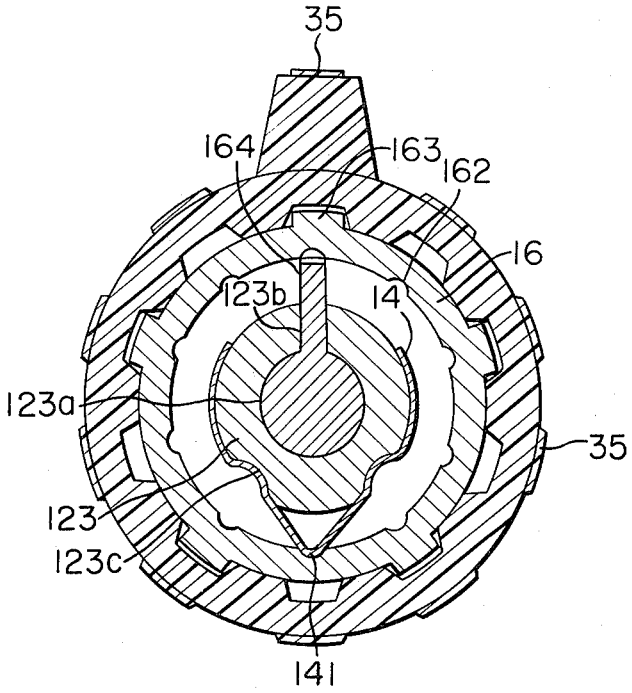
FIG. 3 is a section taken along line III—III in FIG. 2.

The main body 10 comprises a first body 12 having a head 121 formed with a slit 121*a* over which a rod (not shown) is inserted and secured in a conventional manner for connecting the head 121 to one end of a cable or chain (not shown), a protrusion 122 serving as a marking line on which the number of each dial ring is set in a specific combination to open the lock, and a longitudinally extending cylindrical core portion 123 formed with a key bore comprising a central bore 123*a* and a radial slit 123*b*, one or more longitudinal channels 123*c*, and a peripheral groove 123*d* formed near the free end of the core portion 123, four spring members 14, each of which is mounted on the core portion 123 and fitted in the longitudinal channel or channels 123*c*, four inner rings 16, each of which is mounted on the core portion 123 to accommodate each of the spring members 14 therein, and three spacer rings 18 mounted on the core portion 123 and arranged between each two adjacent inner rings 16. As best seen from FIGS. 2 and 3, each of the inner rings 16 has an inner chamber 161 to accommodate therein the concerned spring member 14, a projection 141 thereof being received in one of ten recesses 162 formed at an inner circumference of the chamber 161 for positioning the inner ring during its turning, a plurality of projections 163 which are formed on the outer periphery of the inner ring and will be received in the space formed between each two internal teeth 32 of the concerned dial ring 30 for positioning the dial ring, and a slit 164. In the illustrated embodiment, there are provided five projections 163 for each inner ring 16 but function of the inner ring may be accomplished with only one projection, although it is preferable to form two or more projections to attain smooth turning of the inner ring 16 by rotating operation of the concerned dial ring 30. The configuration of the outermost inner ring is different from that of the other inner rings in that the former has a second chamber 16*a* to accommodate a retainer ring 20 which is to be fitted in the peripheral groove 123*d* formed near the free end of the core portion 123 of the first body 12, to stably but rotatably maintain all of the inner rings 16 on the core portion 123, and that a peripheral groove 16*b* (FIG. 1) is formed near the outer side end thereof to receive a part of the wire spring 304*b* (FIGS. 1 and 4) attached to the outermost dial ring 304 when the dial ring 304 is mounted on the outermost inner ring.

According to the combination lock of the invention, the main body is assembled by the manufacturer as one piece, by placing the spring member 14 in the longitudinal channels 123*c* to mount the same on the core portion 123 of the first body 12, placing the first inner ring 16 on the core portion 123 so as to accommodate the spring member 14 in its inner chamber 161 and to position the inner ring in that the slit 164 of the inner ring opens toward the marking projection 122 formed on the head 121 of the first body 12, inserting the first spacer ring 18 to mount the same on the core portion 123, assembling the second and third spring members 14, inner rings 16 and spacer rings 18 as well as the fourth spring member 14 and the outermost inner ring 16 one by one in the manner similar to that for the first one, and then assembling retainer ring 20 in the peripheral groove 123*d* formed near the free end of the core portion 123 to stably maintain the outermost intermediate ring 16 on the core portion 123.

The second body 40 comprises a head 401 formed with a slit 401*a* over which a rod (not shown) is inserted and secured in a conventional manner for connecting the head 401 to the other end of a cable or chain (not shown). A key-like projection 402 is integral with the head 401. The key-like projection includes a cylindrical rod portion and four key teeth 402*b* as clearly shown in FIG. 1.

It is preferable to form a ridged portion 401*b* on the head 401 to show the direction in which the key tooth 402*b* projects.

The invention will now be further explained as regards to setting and changing the combination.

In order to set the combination, in the first place, the first to third dial rings 301 to 303 of the same configuration are placed one by one on the corresponding inner rings 16 and then the fourth or outermost dial ring 304 is mounted on the outermost inner ring to fit the wire spring 304*b* carried by the dial ring 304 in the peripheral groove 16*b* formed in the outermost inner ring, whereby a desired combination of numbers on each dial ring 30 is represented in a line on the marking projection 122 formed on the head 121 of the first body 12. In such a condition of the lock, the key-like projection 402 of the second body 40 may be fully inserted in the key groove of the main body 10. When dial rings 30 are manually rotated, the corresponding inner rings 16 are rotated due to the engagement of the projection 163 of the inner ring 16 with the internal teeth 32 of the dial ring 30 as that the slit 164 of the corresponding inner ring 16 is out of alignment with the key teeth 402*b* of the projection 402.

In order to change the combination to a new one, the outermost dial ring 304 is first dismounted from the corresponding inner ring by pushing the bent portion 304*b'* of the wire spring 304*b* to release the engagement of the wire spring 304*b* with the peripheral groove 16*b* of the outermost inner ring. Since the upper portion of the wire spring 304*b* is formed with a curved or bowed portion as shown in FIG. 4, pushing of the bent portion 304*b'*, which is located generally at the center of the bowed portion, causes the ends of the bow to spread, thereby spreading the two vertical parallel portions of the spring, as shown in FIG. 4, to thereby effect release thereof from the peripheral groove 16*b*. The other dial rings may then be easily disengaged by sliding the same toward the free end of the cylindrical core. The dial rings are fitted on the inner rings one by one in at the same manner as explained above for setting a new combination but now representing a different combination.

What is claimed is:

1. A cylinder type combination lock comprising:

a first body having a head portion and a cylindrical core portion formed with a key bore, a plurality of inner rings, each of said inner rings having a slot in its inner circumference and at least one protrusion on its outer circumference, first mounting means for mounting said inner rings on said cylindrical core portion to provide for rotation of said inner rings on said cylinder core portion, said inner rings being mounted rotatably to a position where the slots thereof are in groove alignment with said key bore to form a key groove, a second body having a head portion and a key-like projection provided with key teeth of the same number as said inner rings, said key-like projection being adapted to be inserted into said key groove and to be locked therein when at least one of said inner rings is turned to be out of said groove alignment, dial rings of the same number as said inner rings, each of said dial rings having a plurality of indicia on its outer circumference, second mounting means mounting said dial rings on said inner rings, said second mounting means comprising at least one notch on said dial ring for accommodating said protrusion on said inner ring such that said dial ring may be mounted on said inner ring at a desired relative angular position, one of said dial rings constituting an outermost dial ring, one of said inner rings constituting an outermost inner ring and, third mounting means mounting said outermost dial ring on said outermost inner ring, said third mounting means comprising a wire spring having a bent portion and two leg portions parallel to one another, said wire spring being manually positioned in a groove in said outermost inner ring in a mounting disposition to biasingly mount said outermost dial ring on said outermost inner ring and said wire spring is manually manupulated to a release disposition to release said outermost dial ring from said outermost inner ring, whereby said dial rings are thereby removable from said inner rings to permit changing the rotational position of each dial ring relative to its respective inner ring to thereby change the combination of said lock without requiring any tools.

2. A cylinder type combination lock according to claim 1, wherein said first mounting means comprises a retainer ring having an inner diameter less than the outer diameter of said cylindrical core portion and an outer diameter greater than the inner diameter of said outermost inner ring, said cylindrical core portion and said outermost inner ring having a retainer ring groove for receiving said retainer ring to thereby retain said outermost inner ring on said cylindrical core portion.

3. A cylinder type combination lock according to claim 1, wherein said first mounting means comprises a clip spring element biasingly disposed on said cylindrical core portion, there being a clip spring element for each inner ring, each of said clip spring elements having cylindrical portions engaging cylindrical sections of said cylindrical core portion, said cylindrical core portion having longitudinal grooves, each of said clip spring elements having protrusions disposed in said longitudinal grooves.

4. A cylinder type combination lock according to claim 3, wherein each of said clip spring elements has a V-shaped projection portion.

5. A cylinder type combination lock according to claim 4, wherein said first mounting means further comprises a plurality of notches on said inner ring, there being a notch for each indicia on said dial ring, said V-shaped projection portion being biasingly received in said notches to provide a biased engagement, whereby there is such a biased engagement for a plurality of rotational positions of said dial ring corresponding to each indicia on said dial ring.

6. A cylinder type combination lock comprising:

a first body having a cylindrical core portion formed with a key bore, a plurality of inner rings, each of said inner rings having a slot in its inner circumference and at least one protrusion on its outer circumference, first mounting means for mounting said inner rings on said cylindrical core portion to provide for rotation of said inner rings on said cylinder core portion, said inner rings being mounted rotatably to a position where the slots thereof are in groove alignment with said key bore to form a key groove, a second body having a key-like projection provided with key teeth of the same number as said inner rings, said key-like projection being adapted to be inserted into said key groove and to be locked therein when at least one of said inner rings is turned to be out of said groove alignment, a plurality of dial rings of the same number as said inner rings, second mounting means mounting said dial rings on said inner rings, said second mounting means comprising at least one notch on said dial ring for accommodating said protrusion on said inner ring such that said dial ring may be mounted on said inner ring at a desired relative angular position, one of said dial rings constituting an outermost dial ring, one of said inner rings constituting an outermost inner ring, and third mounting means mounting said outermost dial ring on said outermost inner ring, said third mounting means comprising a wire spring having a bent portion and two leg portions parallel to one another, said wire spring being captively retained on said outermost dial ring, said wire spring being manually positioned in a groove in said outermost inner ring in a mounting disposition to biasingly mount said outermost dial ring on said outermost inner ring, said wire spring being manually manipulated to a release disposition to release said outermost dial ring from said outermost inner ring, whereby said dial rings are thereby removable from said inner rings to permit changing the rotational position of each dial ring relative to its respective inner ring to thereby change the combination of said lock without requiring any tools.

7. A cylinder type combination lock comprising:

a first body having a head portion and a cylindrical core portion formed with a key bore, a plurality of inner rings, each of said inner rings having a slot in its inner circumference and at least one protrusion on its outer circumference, first mounting means for mounting said inner rings on said cylindrical core portion to provide for rotation of said inner rings on said cylinder core portion, said inner rings being mounted rotatably to a position where the slots thereof are in groove alignment with said key bore to form a key groove, a second body having a head portion and a key-like projection provided with key teeth of the same number as said inner rings, said key-like projection being adapted to be inserted into said key groove and to be locked therein when at least one of said inner rings is turned to be out of said groove alignment, dial rings of the same number as said inner rings, each of said dial rings having a plurality of indicia on its outer circumference, second mounting means mounting said dial rings on said inner rings, said second mounting means comprising at least one notch on said dial ring for accommodating said protrusion on said inner ring such that said dial ring may be mounted on said inner ring at a desired relative angular position, one of said dial rings constituting an outermost dial ring, one of said inner rings constituting an outermost inner ring and, third mounting means mounting said outermost dial ring on said outermost inner ring, said third mounting means comprising a biasing element which is manually positioned in a mounting disposition to biasingly mount said outermost dial ring on said outermost inner ring and which is manually positioned to a release disposition to release said outermost dial ring from said outermost inner ring, whereby said dial rings are thereby removable from said inner rings to permit changing the rotational position of each dial ring relative to its respective inner ring to thereby change the combination of said lock without requiring any tools, said biasing element being a wire spring having a bent portion and two leg portions, said two leg portions being substantially parallel to one another, said outermost inner ring having a groove for receiving said leg portions, said bent portion of said wire spring being manually movable to thereby spread said leg portions so that the latter disengages from said groove in said outermost inner ring.

8. A cylinder type combination lock according to claim 7, wherein said outermost dial ring has projections for retaining said wire spring on said outermost dial ring, whereby said wire spring is retained as a captive on said outermost dial ring.

* * * * *